US010414525B2

(12) United States Patent
Zoboli

(10) Patent No.: US 10,414,525 B2
(45) Date of Patent: Sep. 17, 2019

(54) COLD PROCESSING SHRINK-WRAPPING MACHINE FOR ITEMS WITH EXTENSIBLE FILM, AND RELATED PROCEDURE

(71) Applicant: FORPAC S.R.L., Noceto (PR) (IT)

(72) Inventor: Elio Zoboli, Noceto (IT)

(73) Assignee: FORPAC S.R.L., Noceto (PR) (IT)

( * ) Notice: Subject to any disclaimer, the term of this patent is extended or adjusted under 35 U.S.C. 154(b) by 466 days.

(21) Appl. No.: 14/912,466

(22) PCT Filed: Mar. 31, 2014

(86) PCT No.: PCT/IB2014/060321

§ 371 (c)(1),
(2) Date: Feb. 17, 2016

(87) PCT Pub. No.: WO2015/028894

PCT Pub. Date: Mar. 5, 2015

(65) Prior Publication Data

US 2016/0200470 A1 Jul. 14, 2016

(30) Foreign Application Priority Data

Aug. 30, 2013 (IT) ..... PR2013A0067

(51) Int. Cl.
*B65B 11/04* (2006.01)
*B65B 21/24* (2006.01)
(Continued)

(52) U.S. Cl.
CPC ..... *B65B 11/04* (2013.01); *B65B 21/245* (2013.01); *B65B 35/36* (2013.01); *B65B 53/00* (2013.01)

(58) Field of Classification Search
CPC ..... B65B 11/04; B65B 21/24; B65B 21/245
(Continued)

(56) References Cited

U.S. PATENT DOCUMENTS 2,535,880 A 12/1950 Tomkins
2,811,916 A * 11/1957 Guilleminot et al. .. B65B 27/04 100/15
(Continued)

FOREIGN PATENT DOCUMENTS

CN 87102880 A 1/1988
CN 1155496 A 7/1997
(Continued)

OTHER PUBLICATIONS

International Search Report, dated Oct. 10, 2014, from corresponding PCT application, PCT/IB2014/060321, 3 pages.
(Continued)

*Primary Examiner* — Stephen F. Gerrity
(74) *Attorney, Agent, or Firm* — Young & Thompson

(57) ABSTRACT

A cold processing shrink-wrapping machine for groups of items with extensible film includes elements (2) for feeding the group of items (4) to be packaged; at least one reel (6) of extensible film (7) for packaging the group of items (4) by wrapping the film around it; elements (10) for holding the group of items; elements (3) for unloading the packaged items, and elements that put the group of items (4) in rotation about a horizontal axis so as to drag the film (7) around it unrolling it from the reel (6) whose axis of rotation is fixed.

13 Claims, 7 Drawing Sheets

(51) Int. Cl.
*B65B 35/36* (2006.01)
*B65B 53/00* (2006.01)

(58) Field of Classification Search
USPC ..... 53/397, 441, 461, 465, 556, 587, 210, 53/211
See application file for complete search history.

(56) References Cited

U.S. PATENT DOCUMENTS

| | | | | | |
|---|---|---|---|---|---|
| 3,605,375 | A * | 9/1971 | Marshall | B65B 27/08 | 53/587 |
| 4,283,903 | A * | 8/1981 | Mayhall et al. | B65B 11/04 | 53/211 |
| 4,355,496 | A * | 10/1982 | Teates et al. | B65B 11/04 | 100/15 |
| 4,461,136 | A * | 7/1984 | Hudson et al. | B65B 11/04 | 53/211 |
| 4,781,215 | A * | 11/1988 | Mayhall, Jr. et al. | B65B 11/04 | 137/580 |
| 4,905,451 | A * | 3/1990 | Jaconelli et al. | B65B 11/045 | 493/440 |
| 5,520,872 | A * | 5/1996 | Scherer | B65H 45/22 | 264/285 |
| 5,799,466 | A * | 9/1998 | Underhill | A01F 15/071 | 53/441 |
| 6,751,931 | B2 * | 6/2004 | Cere' | B65B 21/245 | 53/397 |
| 6,752,056 | B1 * | 6/2004 | Weber | B26D 7/27 | 53/389.2 |
| 8,221,298 | B2 * | 7/2012 | Pirtle et al. | B65H 18/10 | 493/356 |
| 2003/0024213 | A1 | 2/2003 | Cere' | | |
| 2005/0089640 | A1 | 4/2005 | Tanaka | | |
| 2010/0012462 | A1 | 1/2010 | Cerf | | |
| 2010/0236195 | A1 * | 9/2010 | Kollmuss | B65B 11/06 | 53/441 |

FOREIGN PATENT DOCUMENTS

| | | | | |
|---|---|---|---|---|
| DE | 39 02 919 | A1 | 8/1990 | |
| DE | 10 2011 08704 | A1 | 2/2013 | |
| DE | 102014113393 | A1 * | 3/2016 | B65B 11/04 |
| EP | 2206651 | A1 * | 7/2010 | B65B 11/04 |
| GB | 2324075 | A | 10/1998 | |
| JP | S52-051285 | A | 4/1977 | |
| JP | S56-072704 | U1 | 6/1981 | |
| JP | S63-162420 | A | 7/1988 | |
| JP | H04-102516 | A | 4/1992 | |
| JP | H07-025528 | A | 1/1995 | |
| JP | H07-187463 | A | 7/1995 | |
| JP | H09-183409 | A | 7/1997 | |
| JP | 2003-191911 | A | 7/2003 | |
| JP | 2006-044900 | A | 2/2006 | |
| JP | 2009-083903 | A | 4/2009 | |
| JP | 2013-503085 | A | 1/2013 | |
| RU | 2 331 555 | C2 | 8/2008 | |
| WO | WO 9947347 | A1 * | 9/1999 | B31F 1/22 |
| WO | 02/094674 | A1 | 11/2002 | |
| WO | 2011/024050 | A1 | 3/2011 | |
| WO | 2013/045664 | A1 | 4/2013 | |
| WO | 2015/028894 | A1 | 3/2015 | |

OTHER PUBLICATIONS

NPL Document 1 submitted in Third Party Observation for Application No. WO2014IB60321, dated May 7, 2015 (Screenshot of a Video_01 Jul. 16, 2013 (Al.Ma.C. Packaging S.r.l.)).
NPL Document 2 submitted in Third Party Observation for Application No. WO2014IB60321, dated May 7, 2015 (Screenshot of a Video_02 Jul. 16, 2013 (Al.Ma.C. Packaging S.r.l.)).
NPL Document 3 submitted in Third Party Observation for Application No. WO2014IB60321, dated May 7, 2015 (Screenshot of a Video_03 Jul. 16, 2013 (Al.Ma.C. Packaging S.r.l.)).
NPL Document 4 submitted in Third Party Observation for Application No. W02014IB60321, dated May 7, 2015 (Screenshot of a Video_04 Jul. 16, 2013 (Al.Ma.C. Packaging S.r.l.)).
NPL Document 5 submitted in Third Party Observation for Application No. WO2014IB60321, dated May 7, 2015 (Screenshot of a Video_05 Jul. 16, 2013 (Al.Ma.C. Packaging S.r.l.)).
Third Party Observation for Application No. WO2014IB60321, dated May 7, 2015, citing 5 NPL (screenshots of videos 1-5).
Third Party Observation for Application No. WO2014IB60321, dated May 7, 2015, citing WO02-094674.
Third Party Observation for Application No. PCT/IB2014/060321, dated May 26, 2015.

* cited by examiner

COLD PROCESSING SHRINK-WRAPPING MACHINE FOR ITEMS WITH EXTENSIBLE FILM, AND RELATED PROCEDURE

TECHNICAL FIELD

The present invention relates to a shrink-wrapping machine, in particular for packaging groups of six PET bottles, but more generally adapted for packaging items cold using extensible film.

The present invention also relates to a packaging procedure.

BACKGROUND ART

The current state of the art substantially envisages two different types of packaging systems for items in bundles.

A first technique envisages the use of heat-shrink film that is wrapped around the items to be packaged and then shrinks adhering around them by being passed into a relevant oven.

A second technique envisages the use of a cold processing shrink-wrapping machine wherein a reel of extensible film rotates around a group of items held by relevant means for holding them, such as for example in WO 2011/024050. The advantage of such a solution is that the use of an oven for heat-shrinking the film is avoided, as well as less film being used. The only slight drawback of the use of cold extensible film, instead of heat-shrink film, consists of the impossibility to print on such film since the printing would become deformed in the step of extending the film to make it adhere to the items to be packaged.

Cold processing shrink-wrapping machines are however rather complex since the reel of extensible film (which is rather large) is made to rotate around the items to be packed, while they are kept still by relevant means for holding them. This implies the need for sufficient space to make the reel rotate numerous times around the items, as well as the need for special means, sufficiently strong considering the weight of the reel, particularly when it is almost full, which envisage making the reel rotate around the items at such a speed as to allow packaging in a short time. DE 10 2011 081704 A1 shows a packaging machine in which the items are held laterally and the film is wrapped around them through rotations about a vertical axis. In the event in which the items are containers or bottles fed in an erect position, such a machine produces a bundle in which the film is laterally wrapped around the containers leaving the bottom and the mouth of the containers uncovered (i.e. not wrapped or protected), which are hence subject to getting dirty, lacking the necessary hygiene conditions, particularly for containers intended for food.

The same drawbacks are also shown in DE 3902919 A1.

DISCLOSURE OF THE INVENTION

The object of the present invention is to simplify the cold processing shrink-wrapping machines of the prior art to make them less expensive and more efficient.

A further object is to wrap the containers so that the bottom and the mouth area and/or the lid thereof are covered and protected.

Said objects are fully reached by the shrink-wrapping machine according to the present invention, which is characterised by the contents of the claims below and in particular in that it comprises means that make the group of items rotate about a horizontal axis so as to drag the film around it unrolling it from the reel, whose axis of rotation remains fixed.

The present invention also relates to a procedure for packaging items cold with extensible film, which is characterised by the contents of the claims below and in particular in that the group of items to be packaged is held and put in rotation so as to drag the film around it by unrolling it from the reel, whose axis of rotation remains fixed.

BRIEF DESCRIPTION OF DRAWINGS

This and other characteristics are illustrated in more detail by the following description of a preferred embodiment shown by way of a non-limiting example in the appended drawings, wherein.

DETAILED DESCRIPTION OF PREFERRED EMBODIMENTS OF THE INVENTION

Figure 1:
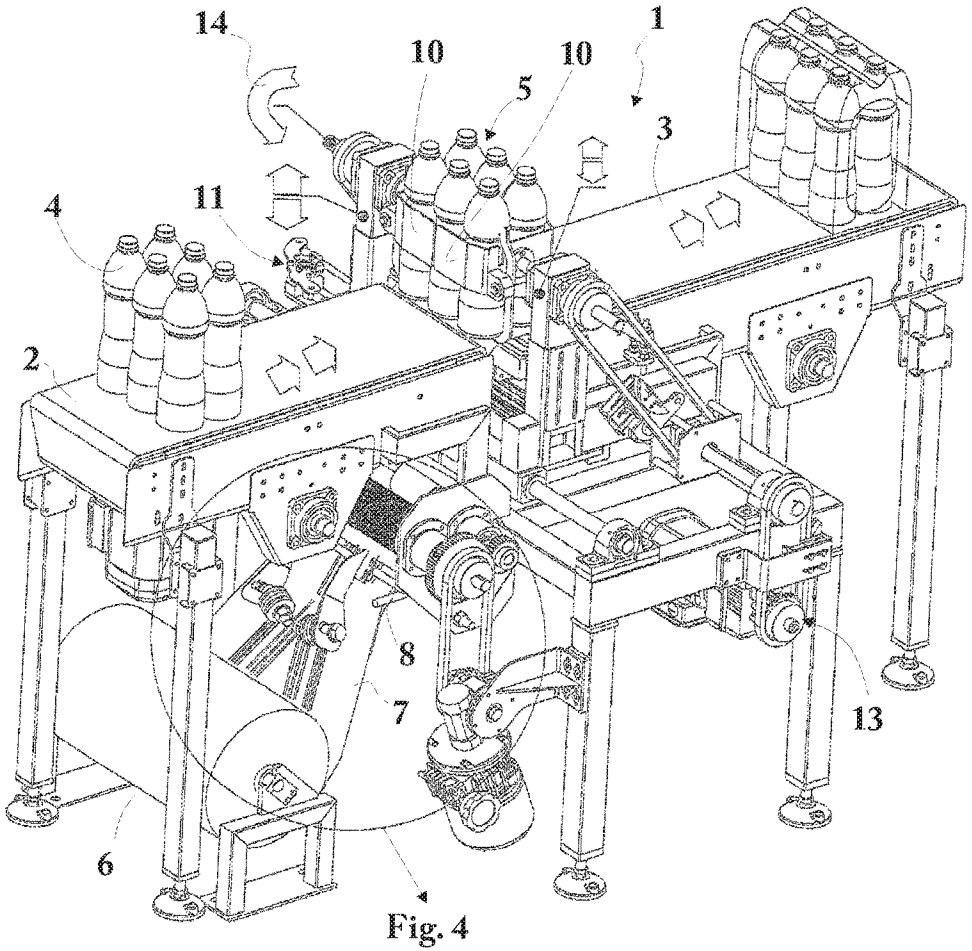
FIG. 1 illustrates a perspective view of the shrink-wrapping machine.
Figure 2:
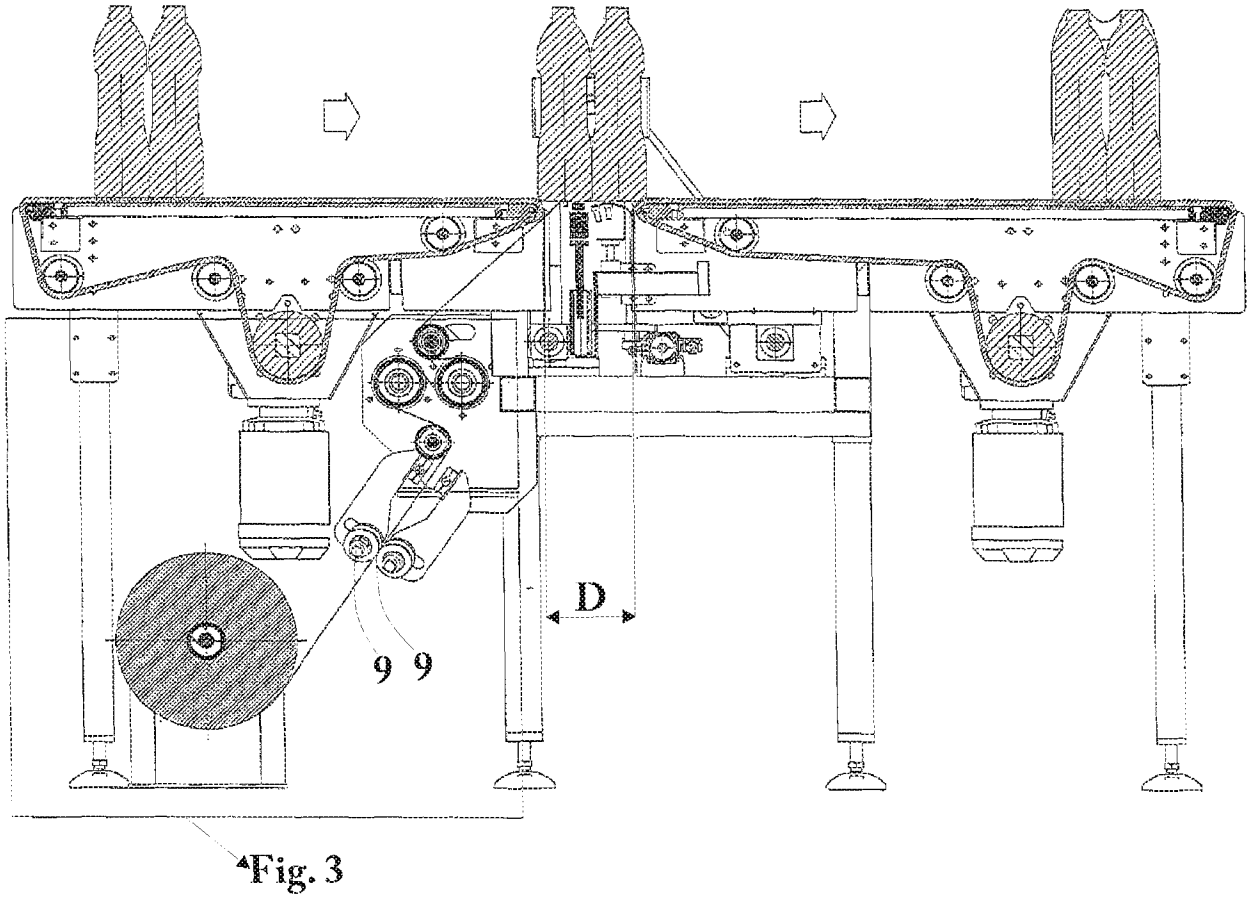
FIG. 2 illustrates a lateral view of the shrink-wrapping machine.
Figure 4:
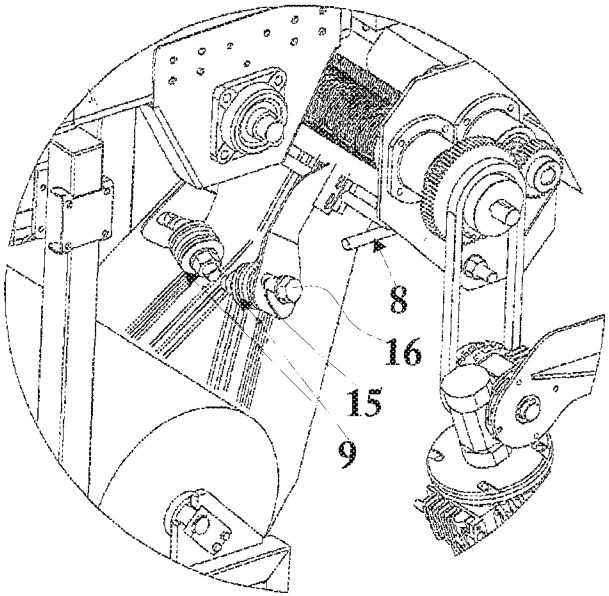
FIG. 4 illustrates a perspective view of a detail of FIG. 1.
Figure 3:
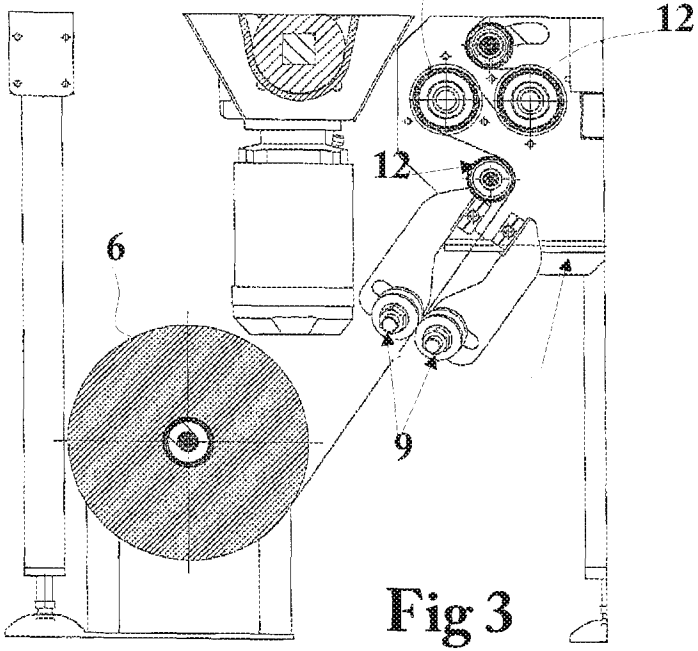
FIG. 3 illustrates a side view of a detail of FIG. 2.
Figure 5:
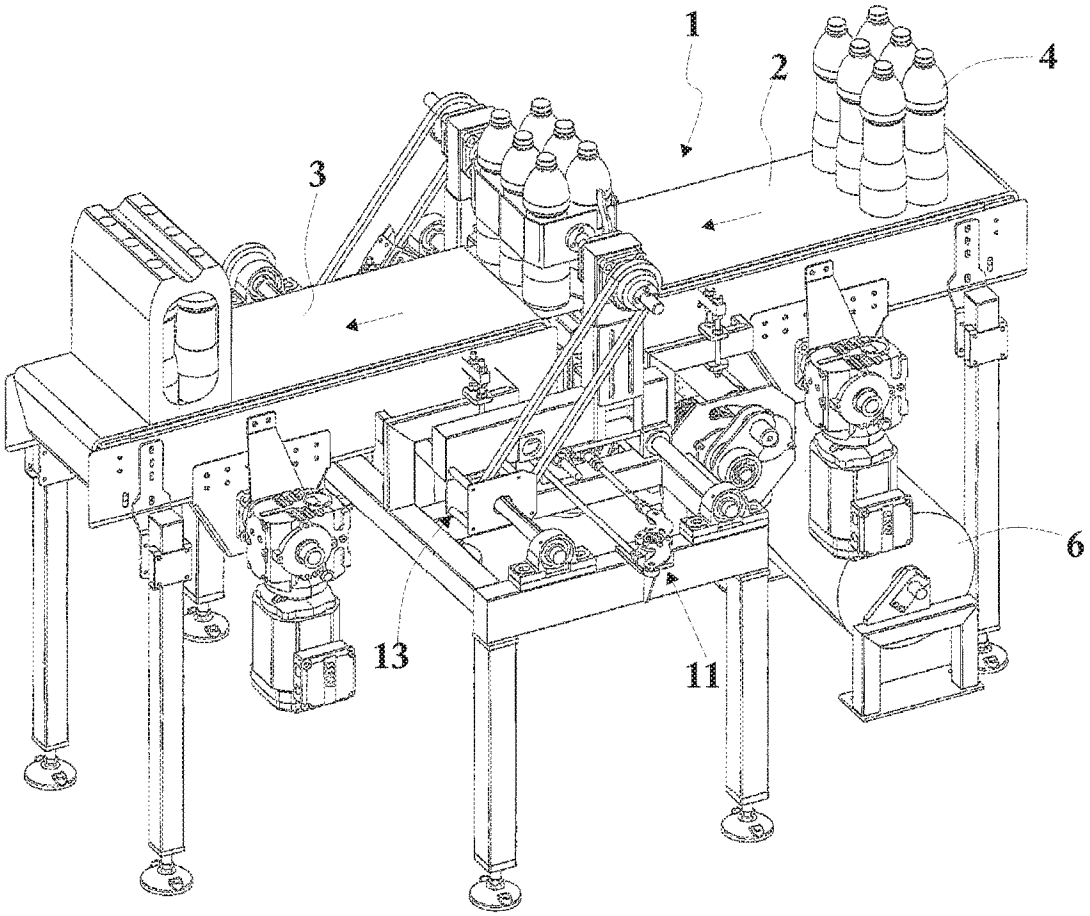
FIG. 5 illustrates the shrink-wrapping machine in a different perspective view from the one shown in FIG. 1.
Figure 6:
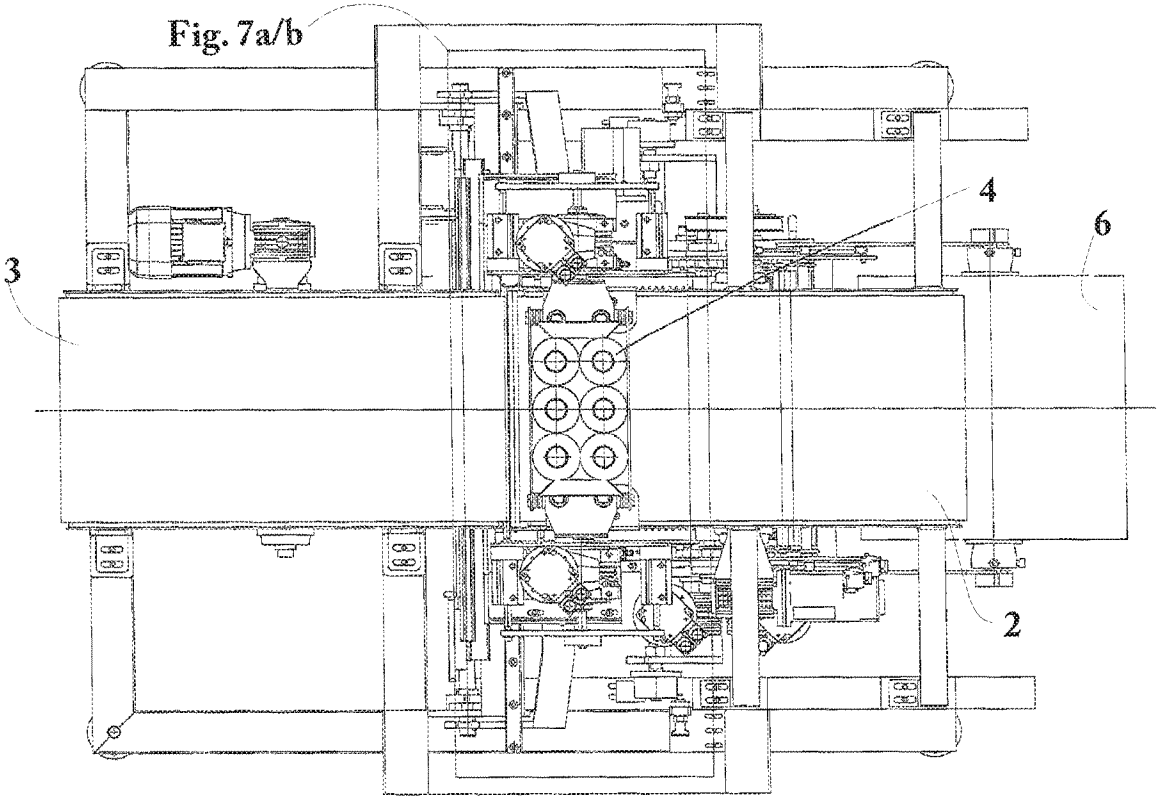
FIG. 6 shows, with more complete details, a plan view of the shrink-wrapping machine.

With reference to the figures, 1 indicates overall a packaging machine, in the specific case a shrink-wrapping machine, comprising an inlet conveyor 2 of the belt type for feeding the products/items to be packaged (typically PET containers), an outlet conveyor 3 of the belt type for the sorting of the packaged products and a packaging station 5 positioned between the two conveyors mentioned above.

The inlet conveyor 2 constitutes means for feeding the items to be packaged.

The outlet conveyor 3 constitutes means for unloading the packaged items.

A reel 6 of extensible film 7 is positioned at the base of the machine and the film is unrolled passing originally through two guides 8 symmetrically arranged at the sides of the film at a shorter distance from each other than the width of the film so as to create two thicker edges (film bunched and overlapping since it is forced to transit in a shorter width than its own) on the outer sides of the extensible film 7.

The guides 8 have an easily adjustable positioning since they are assembled on threaded supports.

A pair of rollers 9 (in the specific case two rollers×2, but 2, 4 or 6 rollers can be used both above and below the film) positioned in the film loading zone opposite one another both above and below the film and preferably inclined by 30° with respect to the advancement direction of the film (this angle can however vary from 15° to 40° and internal with respect to the guides 8, produce further thickening of the film in the central zone adapted to give the packaged product more strength and to allow, through two simple linear parallel incisions, a handle to be afforded in the thickened zone arranged along the advancement direction of the products (and oriented above the two central bottles in the event of a bundle of six PET bottles).

The rollers 9 have an easily adjustable positioning since they are assembled to slide on appropriate slots 15 to which they are then fixed using tightening screws 16, which are loosened so as to be able to reposition the rollers 9.

The packaging station 5 comprises means 10 for holding the items to be packaged, comprising a pair of C-shaped elements and movement means 11 to allow the pair of C-shaped elements to move horizontally perpendicular to the advancement direction of the conveyors 2 and 3 when they approach one another (during the picking step) or when they move apart (during the release step).

According to an embodiment not illustrated, the holding means can also move vertically by means of further relevant vertical movement means (pneumatic or motorised). In this case, the distance between the two conveyors 2 and 3 can be reduced since it is not necessary to create sufficient space for the rotation of the bundle of items.

The holding means 10 are originally also means that put the group of items 4 in rotation about a horizontal axis so as to drag the extensible film 7 around it unrolling it from the reel. The film is wrapped around the items covering and protecting both their bottom and their lid or mouth zone, but leaving the lateral zones partially uncovered. This represents a clear advantage with respect to the solutions of the prior art where the film is wrapped around the lateral surface of the containers (i.e. it only protects the label) but leaves the bottom and mouth uncovered and unprotected, which are more critical from a hygiene point of view.

Figures 7A, 7B:
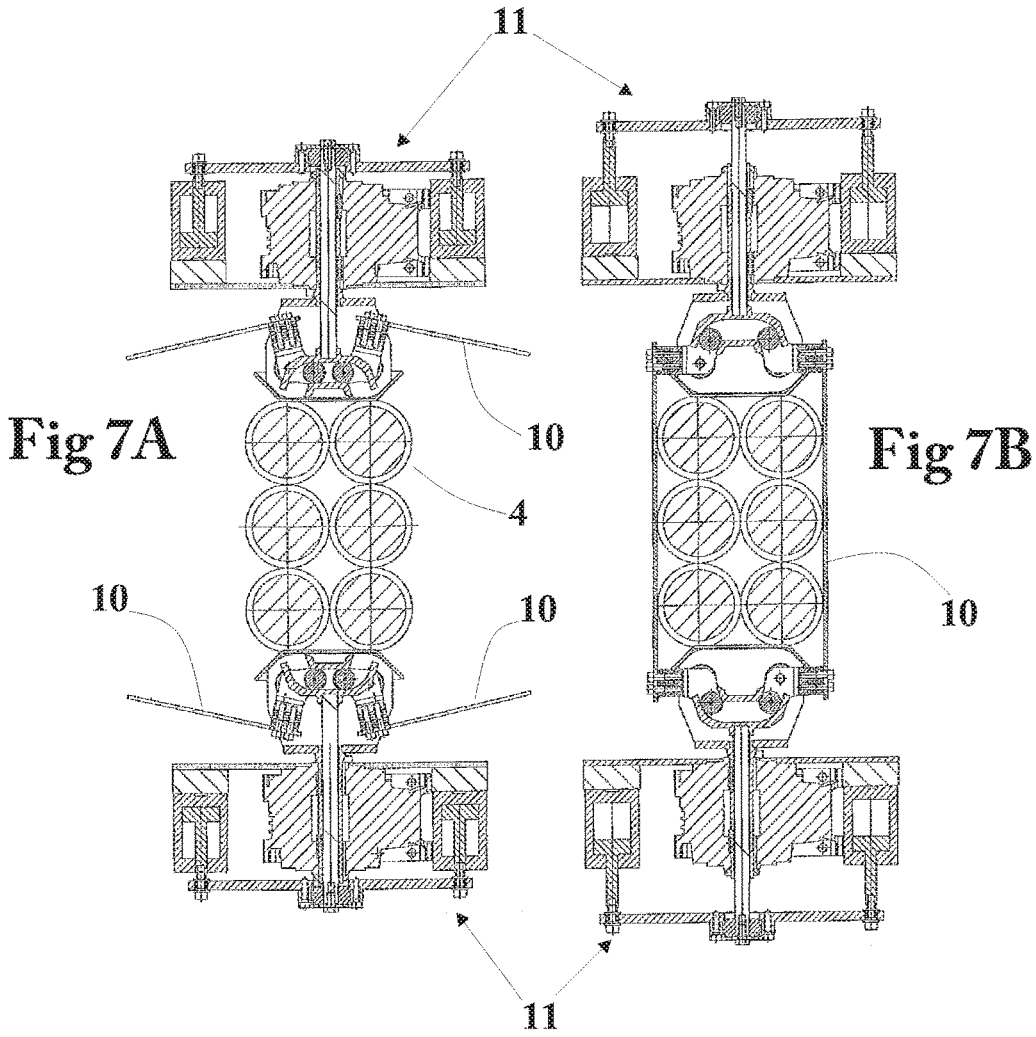
FIGS. 7A and 7B show a detail of FIG. 6 referring to the means for holding and rotating the containers, in two different steps.
Figure 8:
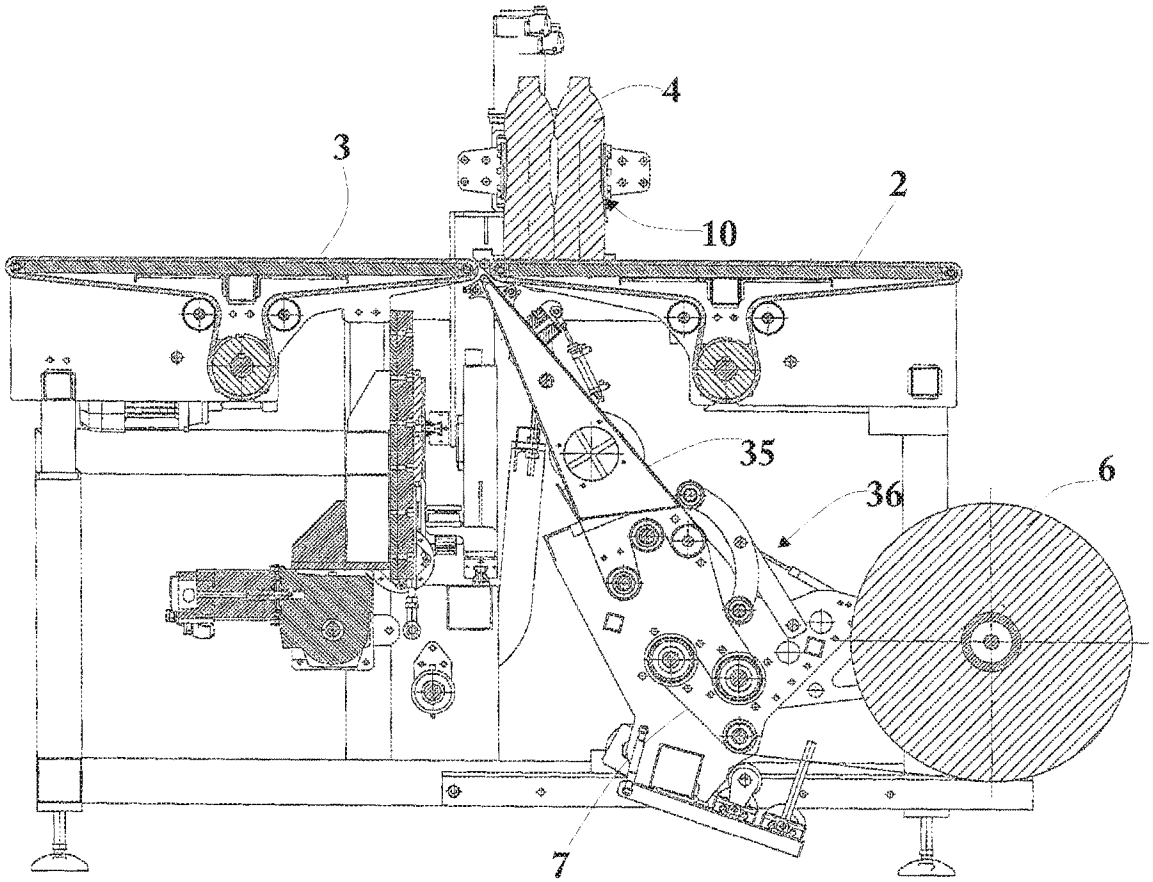
FIG. 8 illustrates a lateral view of the shrink-wrapping machine from the opposite side with respect to the one in FIG. 2 and with more complete details.

According to the illustrations of FIGS. 6, 7A, 7B and 8, and in particular FIG. 7A and 7B, the holding means 10 can comprise, according to one embodiment, two pairs of vanes rotating about their own vertical axis activated by a small piston and a cam21.

With regard to the extensible film 7, as in pallet wrapping machines and in cold processing shrink-wrapping machines of the prior art, the film is pre-stretched while it passes between rolls 12 rotating at different speeds. It is then lifted through innovative air jets (emitted by a tube equipped with a plurality of holes) until it overshoots an opening/slot between the conveyors 2 and 3 resting against the advancing front of items to be packaged.

At this point the holding means 10 intervene (picking step) also trapping the film.

Then the holding means 10 are put in rotation through means indicated with reference number 13 and comprising a motor and various mechanisms, so that the group of items held by the holding means 10 drags the film around itself while said group is put in rotation.

Before the holding means 10 start to rotate (but after they have grasped the group of items to be packaged) a sort of trapdoor not illustrated opens until a distance d is defined between the two conveyors 2 and 3 in the advancement direction of the conveyors so as to allow the rotation of the bundle of items without interference with the conveyors 2 and 3.

If, on the other hand, the holding means 10 can also translate vertically (according to the embodiment described above), they are lifted, also lifting the bundle before its rotation starts and it is not necessary to provide for the use of the trapdoor, since a very limited distance d between the two conveyors is sufficient (substantially a slot of a few centimetres such as to allow the passage of the film).

After a few turns in the direction of the arrow 14, the group of items is wrapped by a sufficient quantity of film and then a glow wire moved vertically by pneumatic means rises to cut the film according to a known way.

After which, the trapdoor is closed again (or the holding means are lowered until the items are brought back onto the conveyor), and the holding means 10 are opened (release step) allowing the bundle of items to be unloaded through the outlet conveyor 3.

Substantially, if the holding means 10 are not equipped with vertical movement, it is necessary to provide the trapdoor and distance d wide enough to allow the rotation of the bundle without hitting the conveyors, whereas if the holding means are also equipped with vertical movement the bundle is lifted before it is made to rotate and therefore a small slot between the conveyors is sufficient for the passage of the film and it is not necessary to create a large opening between them.

The film 7 which is unrolled from the reel 6 is fed to the packaging station 5 via a perforated belt 35.

This is a rotating belt provided with a plurality of holes and equipped internally with suction means adapted to keep the film adherent to the belt during the path towards the packaging station.

The film is then pushed upwards through the opening or slot present between the conveyors 2 and 3 by means of an air jet.

The perforated belt 35 is part of a film supply unit indicated overall by number 36 which, in the event of cleaning and maintenance operations, can be advantageously rotated downwards to facilitate such operations.

According to the present invention the reel 6 of extensible film is unrolled keeping its own axis originally fixed (unlike the technique of the prior art where the reel rotated various times around the group of items), while the group of items is held by rotating holding means that cause it to rotate with the consequent wrapping of the film.

The innovative procedure to which the present invention relates is therefore a procedure for cold packaging groups of items in bundles through extendible film 7 unrolled from a reel 6 with a fixed axis of rotation, comprising the steps of:

- supplying the extensible film 7 to a packaging station 5;
- gripping a group of items to be packaged by coupling the extensible film to the group of items;
- lifting the group of items or, alternatively, opening a trapdoor placed between an input conveyor and an output conveyor, in order to prevent interference with the conveyors of the items;
- rotating the group of items that drag the film around themselves;
- cutting the film;
- lowering the group of items or, alternatively, closing the trapdoor;
- releasing the bundle towards an unloading area.

The film is fed by means of an air jet to the packaging station through an opening or slot present between the inlet and outlet conveyors, so as to wrap itself automatically around the items as a result of their rotation.

The invention claimed is:

1. A cold processing wrapping machine for groups of items with extensible film, said cold processing wrapping machine comprising:

- means (2) for feeding the group of items (4) to be packaged;
- at least one reel (6) of extensible film (7) for packaging the group of items (4) into a "bundle" by wrapping the extensible film around the group of items to form wrapped packaged items;
- means (10) for holding the group of items;

means (3) for unloading the wrapped packaged items; and means (13) that put the group of items (4) in rotation about a horizontal axis so as to drag the extensible film (7) around the group of items unrolling the extensible film (7) from the reel (6), with a horizontal axis of rotation of the extensible film remaining fixed, wherein the means (10) for holding the group of items includes the means (13) that put the group of items in rotation, and wherein said means (10) for holding the group of items is vertical movable for permitting wrapping the group of items (4) during rotation of the group of items (4).

2. The wrapping machine according to claim 1, wherein, said means (10) for holding the group of items comprise a pair of C-shaped lateral rotation and holding elements; and pneumatic or motorized movement means (11) that allow to move the pair of C-shaped lateral rotation and holding elements horizontally perpendicular to an advancement direction of the group of items.

3. The wrapping machine according to claim 1 having means adapted to produce thicker film at the edges of the bundle.

4. The wrapping machine according to claim 3, wherein said means adapted to produce thicker film at the edges of the bundle comprise two lateral guides (8) or bars positioned at a shorter distance from each other than the width of the film on the reel (6) so as to restrict a passing zone of the film causing bunching and thickening of the film at the edges.

5. The wrapping machine according to claim 1 having means adapted to produce thicker film in an upper central part of the bundle.

6. The wrapping machine according to claim 5, wherein said means for producing thicker film in an upper central part of the bundle comprise opposing rollers (9) above and below the extensible film (7) and positioned in the film loading zone and inclined with respect to the horizontal axis of rotation of the film by 15°-40° so as to distribute the film more in a central part hence making the extensible film thicker.

7. The wrapping machine according to claim 6, wherein the rollers are inclined by 30°.

8. The wrapping machine according to claim 1, wherein the means that put the group of items in rotation and said means (10) for holding the group of items together comprise:

two pairs of holding and rotation vanes.

9. The wrapping machine according to claim 1, wherein the means (10) for holding the group of items and the means (13) that put the group of items (4) in rotation about the horizontal axis so as to drag the extensible film (7) around the group of items unrolling the extensible film (7) from the reel (6) form a packaging station (5), and further comprising:

a perforated belt (35) for feeding the film to the packaging station (5), said perforated belt being associated with suction means which keep the extensible film adhered to the perforated belt during the perforated belt's forward path; and an opening or a slot defined in the packaging station (5), so that the rotation of the group of items (4) causes the extensible film (7) to be dragged and to be wrapped around the group of items.

10. A process for cold packaging groups of items in bundles through extendible film (7) unrolled from a reel (6) with a fixed axis of rotation, the process comprising the steps of:

supplying the extensible film (7) to a packaging station (5);

gripping a group of items to be packaged by moving a holding means (10) towards the group of items and horizontally perpendicular to an advancement direction of the group of items;

lifting the group of gripped items;

rotating the group of gripped and lifted items to drag the extensible film around the group of gripped and lifted items forming wrapped items, the group of gripped and lifted items rotating about a horizontal axis; and releasing the wrapped items towards an unloading area by moving the holding means (10) away from the group of wrapped items and horizontally perpendicular to the advancement direction of the group of items.

11. The process according to claim 10, wherein the extensible film is fed to the packaging station through an opening or a slot so as to wrap the extensible film automatically around the group of items as a result of the rotation of the group of items.

12. A process for cold packaging groups of items in bundles through extendible film (7) unrolled from a reel (6) with a fixed axis of rotation, the process comprising the steps of:

supplying the extensible film (7) to a packaging station (5);

gripping a group of items to be packaged by moving a holding means (10) towards the group of items and horizontally perpendicular to an advancement direction of the group of items;

opening a trapdoor placed between an input conveyor and an output conveyor, in order to prevent interference with the conveyors of the group of gripped items during rotation of the group of gripped items;

rotating the group of gripped items to drag the extensible film around the group of gripped items forming wrapped items, the group of gripped items rotating about a horizontal axis;

closing the trapdoor; and releasing the wrapped items towards an unloading area by moving the holding means (10) away from the group of wrapped items and horizontally perpendicular to the advancement direction of the group of items.

13. The process according to claim 12, wherein the extensible film is fed to the packaging station through an opening or a slot so as to wrap the extensible film automatically around the group of items as a result of the step of rotating of the group of items.

* * * * *